United States Patent [19]

Adamson

[11] Patent Number: 4,470,173

[45] Date of Patent: Sep. 11, 1984

[54] DISPOSABLE ONE-PIECE SECURITY SEALING DEVICE

[75] Inventor: Donald Adamson, Warlingham, England

[73] Assignee: Envopak, Ltd., Kent, England

[21] Appl. No.: 411,217

[22] Filed: Aug. 25, 1982

[30] Foreign Application Priority Data

Aug. 27, 1981 [GB] United Kingdom ..... 8126121
Apr. 20, 1982 [GB] United Kingdom ..... 8211382

[51] Int. Cl.[3] ..... B65D 77/10; B65D 33/34

[52] U.S. Cl. ..... 24/30.5 P; 24/16 PB; 24/17 AP; 292/318

[58] Field of Search ..... 24/30.5 P, 30.5 S, 30.5 L, 24/30.5 W, 30.5 R, 16 PB, 17 AP; 292/318, 320, 321; 248/74 PB

[56] References Cited

U.S. PATENT DOCUMENTS

| | | | |
|---|---|---|---|
| 2,936,980 | 5/1960 | Rapata | 24/16 PB |
| 3,147,523 | 9/1964 | Logan | 24/30.5 P |
| 3,467,427 | 9/1969 | Moberg | 24/30.5 P |
| 3,556,575 | 1/1971 | Farkas | 24/16 PB |
| 3,653,095 | 4/1972 | Fernberg . | |
| 3,735,449 | 5/1973 | Rosales | 24/16 PB |
| 3,766,608 | 10/1973 | Fay | 24/16 PB |
| 3,887,965 | 6/1975 | Schuplin . | |
| 3,973,293 | 8/1976 | Nootily . | |
| 4,011,633 | 3/1977 | Seil | 24/16 PB |
| 4,092,765 | 6/1978 | Joyce | 24/16 PB |
| 4,263,697 | 4/1981 | Speedie | 24/30.5 P |
| 4,333,210 | 6/1982 | Burnett | 24/30.5 P |
| 4,424,994 | 1/1984 | Dowden | 292/318 |

FOREIGN PATENT DOCUMENTS

| | | | |
|---|---|---|---|
| 2458943 | 12/1975 | Fed. Rep. of Germany | 24/16 PB |
| 621438 | 6/1961 | Italy | 24/16 PB |
| 1294435 | 10/1972 | United Kingdom | 24/16 PB |
| 1351166 | 4/1974 | United Kingdom . | |

*Primary Examiner*—Victor N. Sakran
*Attorney, Agent, or Firm*—Nolte, Nolte and Hunter

[57] ABSTRACT

A disposable one-piece security sealing device primarily intended to surround the neck of a bag or like package comprises a strap (1) having an enclosure (3) at one end defining a passage (4) through which the other end of the strap is irremovably insertable to an adjustable extent as a result of interaction between a plurality of teeth spaced in a row along the strap with a resiliently deformable member (4*b*) which is integral with the housing and situated at or adjacent a bend (4*a*) in the passage; characteristically an identity or pull-off tab (6) is formed as an extension of the strap around and beyond the enclosure for tearing when required along a line of weakness which extends round the enclosure (3) and terminates in a side edge of the strap. By tearing along that line the end of the strap having the tab (6) is separated from the enclosure (3). There may be two rows of teeth on the strap and the enclosure would then have a passage formed with two channels to accommodate the respective rows of teeth.

9 Claims, 9 Drawing Figures

DISPOSABLE ONE-PIECE SECURITY SEALING DEVICE

This invention relates to a disposable security sealing device which is made in one piece and primarily intended to encompass the neck of a bag or like package for the purpose of preventing or signifying unauthorised interference with the contents of the package.

The device is of the general kind comprising a strap having at one end an enclosure defining a passage through which the other end of the strap is irremovably insertable to an adjustable extent as a result of interaction of a plurality of teeth spaced in a row along the strap with a resiliently deformable member which is integral with the housing and situated at or adjacent a bend intermediate the ends of the passage.

The invention has been devised with the general object of providing a device of this kind which affords at least as high a degree of security protection than its predecessors and yet which is capable of being rapidly removed when required.

It is thus proposed in accordance with the invention that an identity or pull-off tab should be formed as an extension of the strap around and beyond the enclosure, for tearing when required along a line of weakness which extends round the enclosure and terminates in a side edge of the strap such that after tearing along that line the end of the strap having the tab is separate from the enclosure.

Also according to a further feature of the invention there may be two rows of teeth, the passage then being formed with two channels for respectively accommodating the two rows of teeth.

According to further features of the invention the toothed side of the strap may have packet-engageable spikes which project from the toothed side of the strap between the strap teeth and the enclosure, and a label securing cord may be formed integrally with the strap and have its free end securable thereto.

Three particular and at present preferred embodiments of sealing device incorporating the invention are illustrated in the accompanying drawings and are hereinafter described.

Referring now to FIGS. 1 to 4 of the drawings, the one-piece security sealing device therein shown consists essentially of a flexible strap 1 conveniently made of synthetic plastics material such as polyvinyl chloride.

Figure 3:
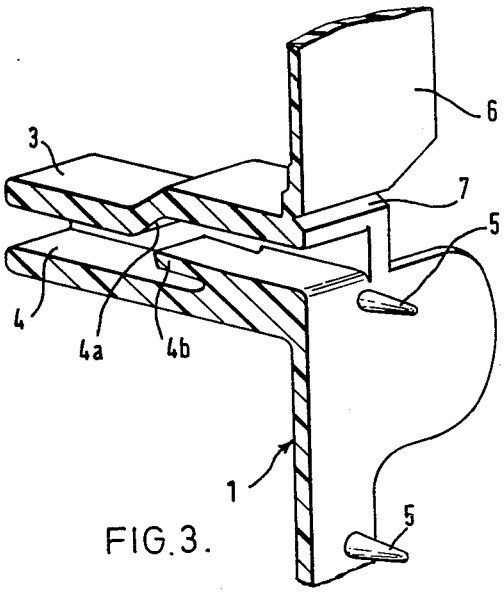
FIG. 3 is an enlarged scale fragmentary longitudinal cross-section through the strap housing.
Figure 4:
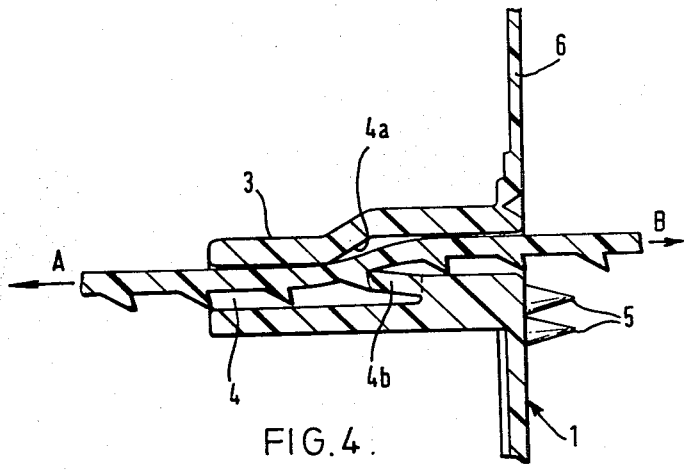
FIG. 4 is an enlarged scale fragmentary cross-section of the free end of the strap operatively inserted through the strap housing as in FIG. 2.

The middle part of the strap is formed on one side only with a multiplicity or row of ratchet-like teeth 2 which may be undercut by an angle of about 10°. Near one end of the strap there is an integrally formed enclsoure 3 which projects substantially perpendicularly from the adjacent non-toothed surface of the strap. As shown in FIGS. 3 and 4, the enclosure defines an open-ended crooked passage 4 which is adapted to receive the opposite end and toothed part of the strap. Intermediate its ends the passage 4 has a bend **4*a* and adjacent this bend on the opposite side of the passage is a resiliently deformable lip 4*b*. Between the teeth 2 and the entrance to the enclosure passage 4 the toothed side of the strap is formed with spikes 5 arranged in a first group of three spikes closely adjacent the entrance to the passage 4 and a second group of six spikes berween the first group and the teeth 2**.

The strap 1 is of enlarged width in the region of the enclosure 3 and beyond the latter it terminates in a substantially rectangular finger tab 6 which can be used if required for labelling or identification purposes. Along the junction between the tab 6 and the enclosure 3 and continuing in a curved or serpentine path to one edge of the strap 1 is groove 7 which acts as a line of shear when, in order to remove the strap from an article, the tab 6 is manually gripped and torn away. The device then becomes wholly unusable and there is no risk of damage to the article to which the strap was attached. At its other, free, end the strap has an opening formed as a longitudinally directed slot 8 which is intended to receive a hook or some improvised tool for drawing the strap through the crooked passage 4.

Figure 1:
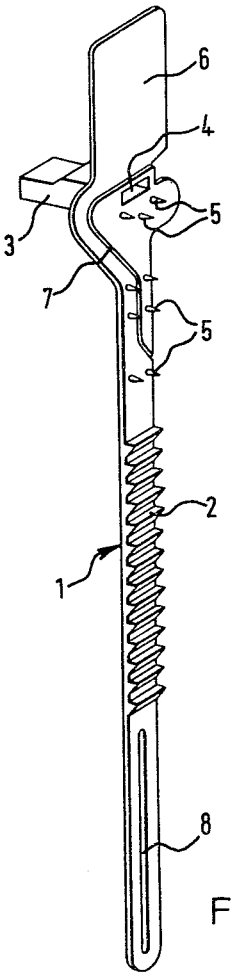
FIG. 1 is a general view of a first preferred embodiment of the security sealing device prior to use.
Figure 2:
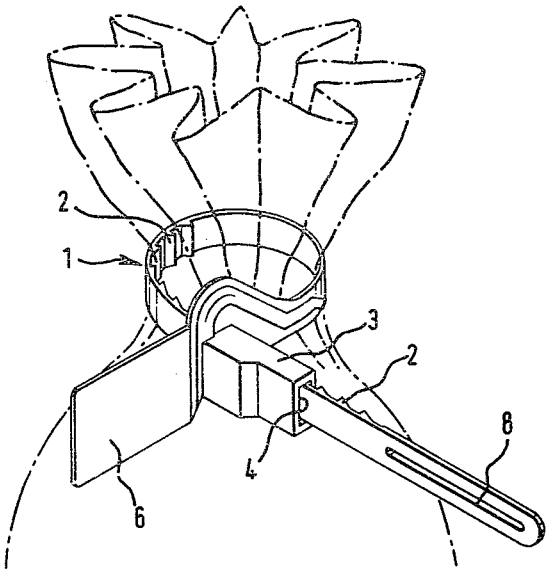
FIG. 2 is a general view showing the security sealing device in use around the neck of a bag.

The device which has been described above is primarily intended for the security sealing of the neck of a bag with valuable contents by drawing the free end of the strap through the passage 4 in the enclosure 3 as far as possible and to cause interlocking of the passage lip **4*b* with the undercut side of one or other of the strap teeth 2. The neck of the bag is thereby drawn into tight folds as shown in FIG. 2 with the spikes 5** biting into the bag fabric and serving to prevent the neck of the bag from being fed through the now closed strap.

The mode of interaction of the lip **4*b* with the teeth 2 of the strap should be apparent by a comparison of FIG. 3 with FIG. 4. Thus FIG. 3 shows the lip 4*b* in a preliminary undeformed position in which it constitutes a straight extension of the entrance of the passage 4 in which position it constricts the passage in the region of the bend 4*a* therein. When however the free end of the strap is pushed into the passage and drawn through it in the direction of arrow A in FIG. 4 the lip 4*b* is deflected by successive teeth 2 so as to maintain the width of the passage along the bend 4*a*. Any attempt to withdraw the strap from the housing passage 4, or simply a natural reaction force, in the direction indicated by the arrow B causes the lip 4*b* to adopt its locking mode as indicated in FIG. 4 where it is shown engaging the undercut face of a tooth 2 and slightly inclined in a passage constricting direction. This effect is augmented to some extent by the increase in the tooth undercut angle which occurs as a result of the deflection of the strap by the bend 4*a* of the passage 4. Thus the greater the force applied in direction B, the greater the resistance exerted by the lip 4*b* on the tooth. Also it is to be noted that the enclosure passage is of sufficient length to ensure that when the seal is in use there will be strap teeth behind and in front of the bend 4*a* in the passage so as entirely to block access to the lip 4b** and thereby prevent its disengagement by improper means.

Figure 5:
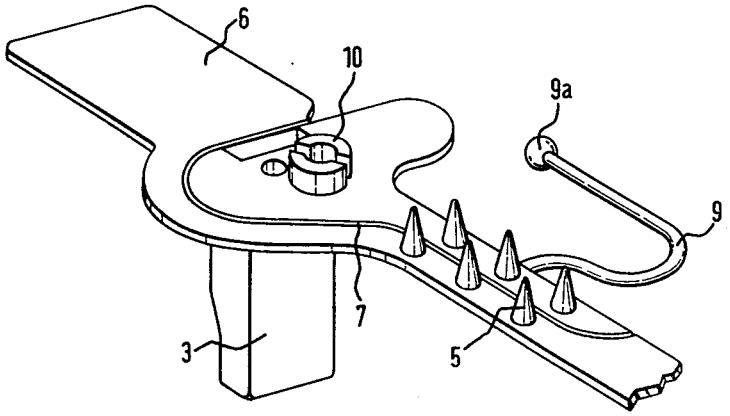
FIGS. 5 and 6 are fragmentary views of a second embodiment which is an elaborated version of the first embodiment which is adapted to hold a label.
Figure 6:
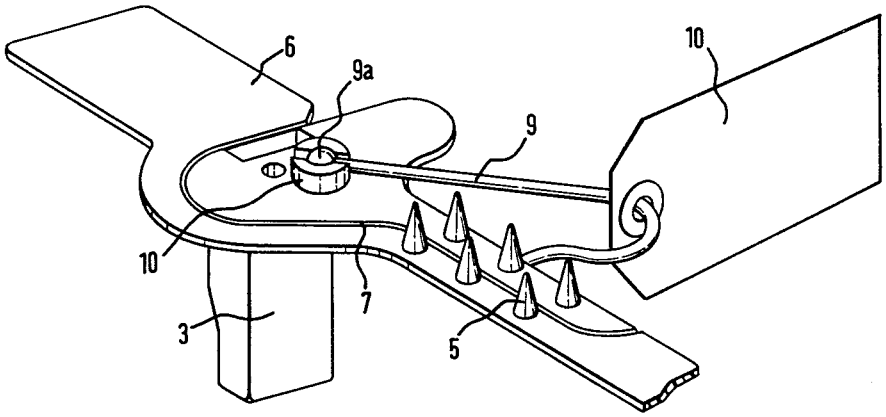

In FIGS. 5 and 6 there is illustrated a part of a second embodiment of the security sealing device which differs from the first embodiment only by the provision at one end of an integral plastics material cord 9 for holding a label 10. This cord 9 extends from one side of the strap 1 in the vicinity of the first group of spikes 5 and terminates in a knob 9a. As shown in FIG. 6 this knob 9a is frictionally receivable in the centre of a diametrically channelled bush 10 which is formed integrally with the strap 1 closely adjacent the mouth of the passage 4 instead of the second group of spikes 5 of the first embodiment. It will be appreciated that when the cord is anchored in this manner it cannot come loose when the device is in use and tightened around the neck of a sack as has been illustrated in FIG. 2 for the first embodiment.

Figure 7:
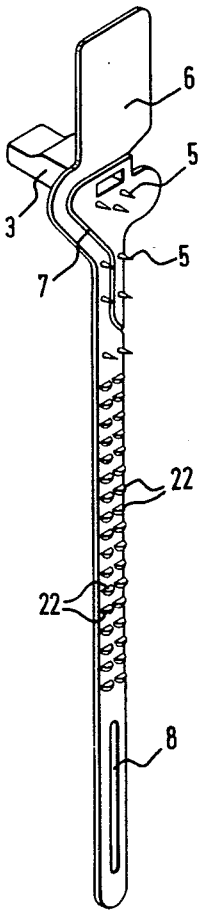
FIG. 7 is a general view similar to FIG. 1 of a third embodiment.
Figure 8:
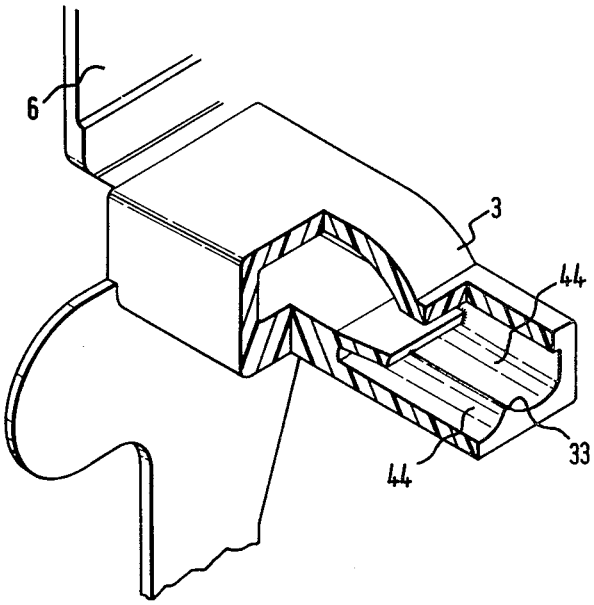
FIG. 8 is an enlarged scale perspective view, partly in cross-section, of the strap housing of the second embodiment.
Figure 9:
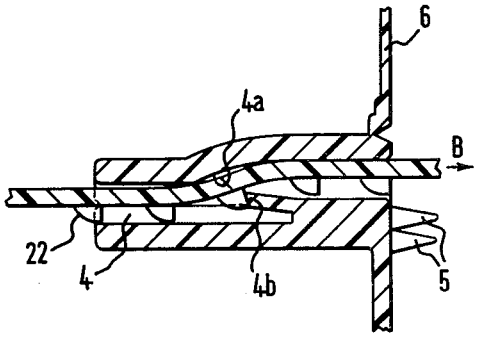
FIG. 9 is an enlarged scale longitudinal section of the strap housing shown in FIG. 7.

A third embodiment of the invention is illustrated in FIGS. 7, 8 and 9, and differs from the first two embodiments firstly in that the middle part of the flexible strap 1 is formed on one side only with two parallel rows of laterally aligned separate substantially semi-circular teeth 22 and secondly in that the passage 4 through the enclosure 3 is longitudinally divided by a rib 33 into two laterally adjoining channels 44 which serve separately to accommodate the respective rows of teeth 22. By these means the resistance of the seal to tamperage or an unauthorised attempt to release the strap from the housing and then re-engage the strap within the housing in an undetectable manner is enhanced.

I claim:

1. In a disposable one-piece security sealing device for enclosing an article which includes a strap of flexible material having integrally formed along one face thereof a row of ratchet-like teeth, an enclosure formed at one end of said strap and projecting in a direction transverse thereto, said enclosure defining therein a passage dimensioned so as slidably to accommodate the part of said strap which is formed with said teeth, said passage, in turn, being formed with resilient detaining means engageable with said teeth in such manner as to permit sliding movement of said strap in an entering direction and preventing sliding movement in a reverse, withdrawing, direction, the improvement comprising a bend formed on one side of said passage opposite said resilient detaining means, said resilient detaining means being formed as a lip which is resiliently bendable in the direction away from said bend to allow said teeth of said strap to be initially drawn through the passage by sliding over one side of said lip and said lip being resiliently bendable in the opposite direction towards said bend whereby upon contact with a face of one of said teeth when tension is applied to the strap in the withdrawal direction, withdrawal of said strap relative to said passage is prevented.

2. A disposable one-piece security sealing device in accordance with claim 1, wherein the longitudinal axis of the inlet end of said passage is substantially parallel with the longitudinal axis of the outlet end of said passage and offset therefrom, said inlet and outlet ends of said passage being joined by said bend, and said lip in the unbent condition projects substantially parallel to the longitudinal axes of said inlet and outlet ends of said passage.

3. A disposable one-piece security sealing device in accordance with claim 1, wherein said bend has a flat surface plane connecting the inlet and outlet ends of said passage.

4. A disposable one-piece security sealing device in accordance with claim 1, wherein said teeth are formed as two laterally spaced rows which project substantially perpendicularly from the said face of said strap, and said passage through said enclosure is longitudinally divided by a rib extending along the surface of the side of said passage opposite the side formed with said bend whereby two laterally adjoining channels are formed which serve to accommodate each of said rows of teeth.

5. A disposable one-piece security sealing device in accordance with claim 4, wherein said lip is fixed at both sides thereof to the corresponding sides of said passage.

6. A disposable one-piece security sealing device in accordance with claim 1, wherein said passage is of sufficient length and there are sufficient teeth formed on said strap to ensure that in the operative state of said device there are teeth behind and in front of said bend in said passage.

7. A disposable one-piece security sealing device in accordance with claim 1, wherein said strap further comprises at least one group of pointed spikes formed integrally with said strap which project perpendicularly from said face of the strap having said teeth formed thereon, said spikes located on a length of said strap between said enclosure and said teeth.

8. A disposable one-piece security sealing device in accordance with claim 1, wherein a label-securing cord is formed integrally with said strap, said cord having a free end terminating in an enlargement which is frictionally receivable and retainable in a hollow boss formed upon said strap adjacent said enclosure, said hollow boss being formed with a groove to accommodate part of said cord which is adjacent said enlargement.

9. A disposable one-piece security sealing device in accordance with claim 1, wherein a flat tab formed at the end of said strap beyond said enclosure, and a serpentine line of shear extending from the junction formed between said tab and said enclosure to a side edge of said strap whereby said enclosure is severed from said housing when said tab is manually pulled or twisted.

* * * * *